United States Patent [19]

Chamberlin

[11] Patent Number: 4,852,601

[45] Date of Patent: Aug. 1, 1989

[54] THERMALLY-ACTIVATED DRIP VALVE

[76] Inventor: John M. Chamberlin, 2800 Dunsinane Rd., Pensacola, Fla. 32503

[21] Appl. No.: 292,860

[22] Filed: Jan. 3, 1989

[51] Int. Cl.[4] ..... F16K 31/64; E03B 7/12

[52] U.S. Cl. ..... 137/62; 137/79; 236/93 R; 236/102; 236/103; 237/80

[58] Field of Search ..... 137/59, 60, 61, 62, 137/79; 236/93 R, 102, 103; 237/80

[56] References Cited

U.S. PATENT DOCUMENTS

| | | | |
|---|---|---|---|
| 330,664 | 11/1885 | Bacon et al. | 137/62 |
| 360,139 | 3/1887 | Browne | 137/61 |
| 1,067,409 | 7/1913 | Daniel | 137/60 |
| 1,277,197 | 8/1918 | Crandon et al. | 137/59 |
| 2,872,120 | 2/1959 | Weiland | 236/102 |
| 3,320,965 | 5/1967 | Morgan | 137/62 |
| 3,369,556 | 2/1968 | Allderdice | 137/62 |
| 3,380,464 | 4/1968 | Arterbury et al. | 137/60 |
| 3,397,711 | 8/1968 | Strange | 137/62 |
| 3,446,226 | 5/1969 | Canterbury | 137/62 |
| 3,511,711 | 5/1970 | Ljutove | 137/60 |
| 3,719,322 | 3/1973 | Gifford | 236/102 |
| 4,117,856 | 10/1978 | Carlson | 137/62 |
| 4,205,698 | 6/1980 | Hucks | 137/62 |
| 4,437,481 | 3/1984 | Chamberlin et al. | 137/60 |
| 4,441,327 | 4/1984 | Klee et al. | 236/102 |
| 4,456,024 | 6/1984 | Roberts | 137/62 |
| 4,484,594 | 11/1984 | Alderman | 137/62 |
| 4,522,219 | 6/1985 | Ohkata | 137/62 |
| 4,638,828 | 1/1987 | Barrineau, Sr. et al. | 137/62 |

*Primary Examiner*—George L. Walton
*Attorney, Agent, or Firm*—John E. Benoit

[57] ABSTRACT

A self-actuating drip valve for attachment to a standard outdoor faucet for the prevention of freezing of such exposed faucets and water pipes leading to the faucet. A tube includes a collar at one end for securing to the end of the faucet. A stem extends within the tube so as to be adjacent the faucet. One or more ports extend between the faucet and the interior of the tube. The distal end of the stem mates with an orifice through the distal end of the tube. The tube and stem have different coefficients of expansion, one being plastic and the other being metal. In practice, the tube is attached to the faucet, which is open, and is filled with water. When the outside ambient temperature drops, the tube and stem contract at different rates and the relative movement opens the orifice in the distal end of the tube so as to permit water to drip therethrough.

6 Claims, 1 Drawing Sheet

THERMALLY-ACTIVATED DRIP VALVE

The present invention relates to a temperature-activated valve and more particularly to a valve which can be attached to an existing external faucet so as to cause the faucet, and the water line feeding the faucet, to continuously drip water and, thus, keep the line and the faucet from freezing when the outside temperature drops below freezing.

The problem of installed plumbing, particularly in the southern part of the United States, often includes outside water faucets which do not have adequate protection from an occasional severe drop in temperature to below freezing. The problem is so common that in many cities of the south the television weatherman will advise, "Drip your faucets tonight and until the freeze is over." If not dripped, the water in the faucet freezes, the forming ice expands, and the faucet may rupture. When the temperature rises to above freezing, the water runs from the ruptured faucet, sometimes being undetected for long periods. In more severe cases the water in the line feeding the faucet may also freeze and rupture that line. Inasmuch as such lines are normally within the walls, floors, or ceilings of a structure, the resulting water flow can cause considerable damage beyond that of the necessity to replace the damaged faucet. Yet many people forget, are not home, or do not know how to drip a faucet.

Prior proposed devices describe a number of approaches toward solving this problem. Such solutions range from insulating the faucet (which generally only postpones the freezing) to devices which contract to open a bypass (U.S. Pat. No. 1,277,197 to Crandon), devices having a one-time release via pressure and temperature (U.S. Pat. No. 3,320,965 to D. L. Morgan), thermostatic wafers (U.S. Pat. No. 3,397,711 to Strange), and the use of thermally expanding or contracting fluids (U.S. Pat. No. 4,205,698 to Hucks and U.S. Pat. No. 3,446,226 to Canterbury). Some solutions utilize water freezing and expanding as the activating mechanism (U.S. Pat. No. 3,511,253 to Ljutove, U.S. Pat. No. 3,369,556 to Allderdice, U.S. Pat. No. 3,380,464 to Arterbury, and U.S. Pat. No. 4,437,481 to Chamberlin). Bacon, in U.S. Pat. No. 330,664, uses the differential expansion of two metals in contact with water and in combination with a water service pipe and a waste water pipe to provide a bypass to the waste water pipe for protection of indoor piping. Applicant owns a copending application (U.S. patent application Ser. No. 07/198,014) which describes a drip valve which uses the differential expansion of metal and plastic to control water flow.

An object of the present invention is to provide an entire whole valve for removable attachment to an external water faucet, which valve will automatically bleed, or drip, sufficient line water to prevent the faucet and adjacent line from freezing when the outside temperature drops below freezing.

A further object of the present invention is to provide a valve which will attain an increased flow or bleed of water as required by decreasing ambient temperature conditions to prevent freezing of water in the faucet.

A further object of the present invention is to provide a valve which requires no resetting after actuation.

A further object of the present invention is to provide a valve which, though temperature-sensitive, has resilient seals capable of opening with contraction and yet allows further compression beyond the initial setting.

A further object of the present invention is to provide a valve which contains water supplied from the water contained in the pipes of a warm home.

These and other objects of the present invention will become obvious from the following description taken together with the drawings.

SUMMARY OF THE INVENTION

A thermally-activated drip valve for attachment to a standard outdoor faucet for the prevention of freezing of such exposed faucets and water pipes leading to the faucet. A tube includes a collar at one end for securing to the end of the faucet. A stem extends within the tube so as to be adjacent the faucet. One or more ports extend between the faucet and the interior of the tube. The distal end of the stem mates with an orifice through the distal end of the tube. The tube and stem have different coefficients of expansion, one being plastic and the other being metal. In practice, the tube is attached to the faucet, which is opened so as to fill the tube with water. When the outside ambient temperature drops, the tube and stem contract at different rates and the stem moves away from the orifice in the distal end of the tube so as to permit water to drip therethrough.

DETAILED DESCRIPTION OF THE PREFERRED EMBODIMENTS

Figure 1:
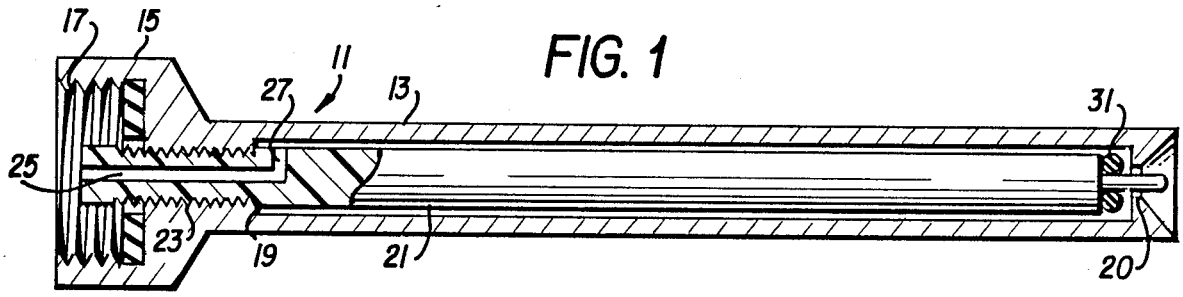
FIG. 1 is a cross-sectional view of one embodiment of the invention.
Figure 2:
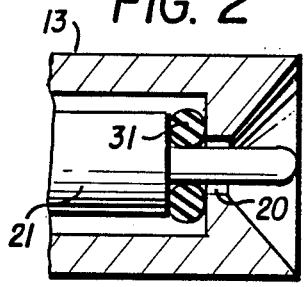
FIG. 2 is a partial sectional view of the valve of FIG. 1 in a closed position.

Turning now to the drawings, there is shown in FIGS. 1 and 2 a first embodiment of the present invention.

Drip valve assembly 11 includes tube 13 which, in the present embodiment, is made of a metal. This tube terminates in collar 15, which has internal threading 17 at the outer edge and internal threading 19 in the interior of the tube and collar. Internal threading 17 is adapted to mate with the outside faucet (not shown) of a standard home. Metal tube 13 terminates at its other end in orifice 20, which extends through the wall of the tube.

Stem 21, which in this embodiment is made of a plastic, extends axially within tube 13 and includes external threading 23 and terminates in a square cross-sectional area in order to permit grasping and turning of the stem for adjustment purposes. Threading 23 mates with internal threading 19 of tube 13. Port 25 extends through the center of the stem and terminates in port 27, which extends through stem 21 to the interior of tube 13 so as to provide a passage for water between the house faucet and the interior of tube 13.

FIG. 1 shows the stem and compressible member 31, such as an O-ring, in an open position, which allows water to pass from the interior of the stem outwardly through port 20. FIG. 2 shows the stem in its closed position, wherein tip 29 extends into orifice 20 and compressible O-ring 31 abuts against the interior of tube 13 so as to effectively close orifice 20.

In operation, after the valve is placed tightly on a faucet, the faucet is opened and the valve is substantially filled with water from the house, which provides a relatively warm water supply. With the valve being in the position as shown in FIG. 2, this water is retained within tube 13. When the outside ambient temperature attains a level which is predetermined by the setting of stem 21 within the faucet relative to the tube through adjustment of the relative position of threaded members 19 and 27, the tube and the stem both commence to contract. Since the stem is made of a plastic material, it contracts further than does the metal tube, thus attaining its position as shown in FIG. 1 wherein compressible O-ring 31 is no longer in contact with the tube and water may flow through orifice 20.

With the proper predetermined compression of O-ring 31, the water flow will begin to flow at a temperature of between 33° F. and 35° F. This water flow will continue until such time as the ambient temperature rises to a point that the stem and tube return to their position as shown in FIG. 2, wherein orifice 20 is closed and water no longer flows.

When the ambient temperature drops below freezing and the valve drips water, the rate of water dripping becomes self-controlling at a rate which is just sufficient to prevent freezing. Dripped water is replaced by relatively warmer water from the house, through ports 25 and 27, to within tube 13. This water brings latent heat, and this latent heat offsets heat lost from tube 13 to the atmosphere. Too much water flow thus warms tube 13 and stem 21, expanding both the stem and the tube. The stem expands more than the tube, thus curtailing water flow. Too little water flow brings insufficient offsetting latent heat, thus further cooling the stem and the tube, with the stem shrinking more than the tube and tending to further open port 20, causing increased water flow. Therefore, the valve as an entity self-controls dripping at just that rate which will prevent freezing regardless of outside ambient temperature.

It should be noted that the operation of this valve is dependent upon its proximity to the available relatively warm water supply of the house. This is due to the fact that if the valve is attached to a place remote from the house wherein water in the supply is allowed to become quite cold itself, the cold water causes the valve to open still more when the dripping begins. Additionally, it is possible that if the valve is removed from its proximity to the house, it can also cause freezing of the valve.

Figure 3:
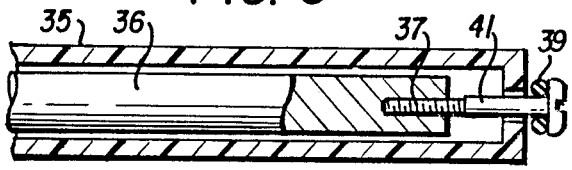
FIG. 3 is a partial sectional view of a modification of the valve of FIG. 1.

FIG. 3 shows the valve of FIG. 1 wherein the materials are reversed. As shown, the tube is made of a plastic material while stem 37 is of a metal material. In this configuration, stem 36 has a threaded borehole 37 in its distal end. Threaded bolt 41 extends through orifice 34 in tube 35 and compresses a resilient O-ring 39. When the ambient temperature drops, tube 35 contracts at a greater rate than does metal stem 37 so as to open the valve to the position shown in FIG. 3. When the temperature is normal, the O-ring 39 will be in contact with tube 35 so as to cover orifice 34 and close the valve.

The use of the resilient material such as an O-ring provides the additional protection for the valve should the temperature rise in the higher ranges. The resilient material can absorb any excess expansion of the stem and/or tube so as to prevent damage to the valve.

Figure 4:
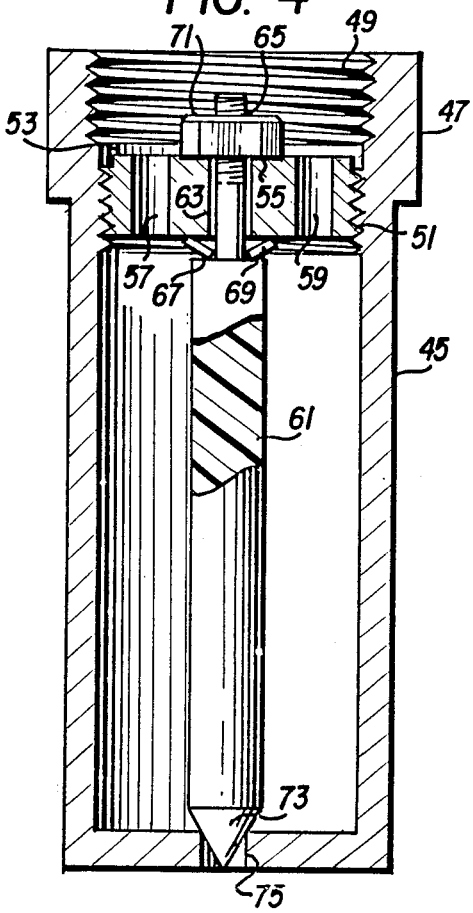
FIG. 4 is a cross-sectional view of a further embodiment of the invention.
Figure 5:
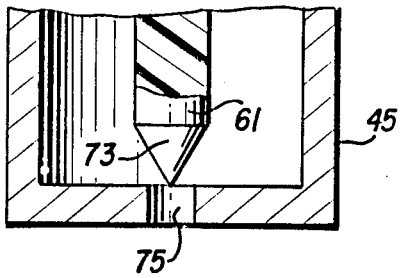
FIG. 5 is a partial sectional view of the valve of FIG. 4 in an open position.
Figure 6:
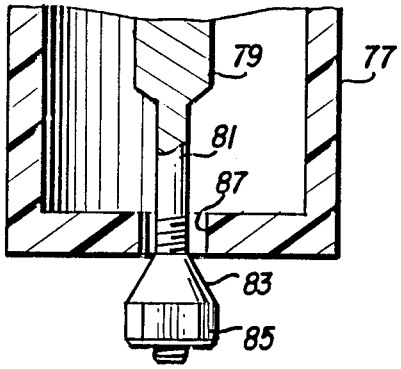
FIG. 6 is a partial sectional view of a modification of the valve of FIG. 4.

FIGS. 4–6 disclose further modifications of the valve previously discussed. FIGS. 4 and 5 show a valve in its closed and open positions, respectively. This valve includes tube 45, which is metal and which terminates in collar 47 internally threaded at 49 and at 51. Spacer 53 is externally threaded so as to be adjustable within threads 51 of collar 47. Spacer 53 includes central orifice 55 and ports 57 and 59. As was the case in the valve of FIG. 1, ports 57 and 59 connect the interior of tube 45 with the outdoor faucet of the home.

Stem 61, which in this instance is of a plastic material, has a reduced section 63 at one end thereof. This section extends through orifice 55 and has an external thread 65 at its outer end. Spring washer 69 is passed over reduced section 63 before it is inserted into orifice 55 so as to abut between shoulder 67 of stem 61 and spacer 53. Stem 61 is then secured in position by means of nut 71, which also provides for adjustment of the position of stem 61. Stem 61 terminates in bevelled end 73, which mates with orifice 75 in tube 45. FIG. 5 shows the valve in its open position wherein bevelled section 73 moves away from orifice 75 so as to permit flow of the water therethrough.

The valve operates in substantially the same manner as does the valve of FIG. 1, with the exception of the use of the spring washer in place of resilient material. The spring washer allows for relative movement between the stem and spacer 53 and, thus, relative movement between stem 61 and tube 45. Additionally, the spring washer protects against excessive expansion in very high temperatures much the same as does the resilient material used in the valve of FIG. 1.

When the ambient temperature reaches a predetermined outside temperature, both stem 61 and tube 45 will begin to contract. Since stem 61 is of a plastic material, it will contract to a greater extent than tube 45 so as to open orifice 75 as shown in FIG. 5 to allow passage of water from the interior of tube 45, thus creating the constant desired drip.

FIG. 6 discloses a modification of the valve in FIG. 4 wherein the materials are reversed. In this illustration, tube 77 is of a plastic material and stem 79 is of a metal material. Stem 79 has a reduced section 81 which passes through orifice 87. The stem terminates in a truncated metal sleeve 83 which is secured to nut 85 and threaded onto the distal end of the stem to the position which is desired for proper operation. Again, the operation of the valve with this modification is substantially the same as the operation previously described.

The present invention provides a simplified valve which is operable as long as it is attached close to the supply of the warm water within a house.

I claim:

1. A self-actuating drip valve for attachment to a standard external water faucet to prevent freezing of water pipes exposed to outside temperatures comprising a hollow tube having an internally threaded collar at one end thereof, said collar adapted to be removably attachable to an external water faucet, said tube having a first coefficient of expansion;

at least one port connecting said faucet to the interior of said tube whereby the interior of said tube is filled with water when said faucet is open;

an orifice through the other end of said tube;

an adjustable stem secured within said threaded collar at said one end of said tube and extending substantially the length of said tube, said port extending from the interior of said threaded collar and through said stem to a point interior of said hollow tube, said stem having a second coefficient of expansion different from said tube; and compressible means at the distal end of said stem for releasably sealing said orifice in said tube, whereby a predetermined drop in the ambient outside temperature causes relative movement between said tube and said stem so as to move said compressible means away from said orifice at a predetermined ambient temperature set by adjusting said stem and permit water to flow from said port into said hollow tube and out through said orifice, wherein said valve self-regulates the water flow through said tube and orifices so as to balance the heat loss to the outside ambient temperature by said faucet and said valve with available latent heat from the water flow.

2. The drip valve of claim 1 whereas said tube is of a metal material and said stem is of a plastic material.

3. The drip valve of claim 1 where said tube is of a plastic material and said stem is of a metal material.

4. A self-actuating drip valve for attachment to a standard external water faucet to prevent freezing of water pipes exposed to outside temperatures comprising a hollow tube having an internally threaded collar at one end thereof, said collar adapted to be removably attachable to an external water faucet, said tube having a first coefficient of expansion;

adjustable spacer means secured within said threaded collar at one end of said tube;

at least one port connecting said faucet to the interior of said tube through said spacer whereby the interior of said tube is filled with water when said faucet is open;

an orifice through the other end of said tube;

a stem extending through said spacer remote from said port and resiliently secured to said spacer so as to permit movement of said stem along the axis of said hollow tube and relative to said spacer; said stem having a second coefficient of expansion different from said tube; and the distal end of said stem being configured for releasably sealing said orifice in said tube, whereby a predetermined drop in the ambient outside temperature causes relative movement between said tube and said stem so as to move said distal end of said stem away from said orifice at a predetermined ambient temperature set by adjusting said spacer and permit water to flow from said port into said hollow tube and out through said orifice, wherein said valve self-regulates the water flow through said tube and orifice so as to balance the heat loss to the outside ambient temperature by said faucet and said valve with available latent heat from the water flow.

5. The drip valve of claim 4 whereas said tube is of a metal material and said stem is of a plastic material.

6. The drip valve of claim 4 where said tube is of a plastic material and said stem is of a metal material.

* * * * *